US007674206B2

(12) United States Patent
Jones

(10) Patent No.: US 7,674,206 B2
(45) Date of Patent: Mar. 9, 2010

(54) COMPACT PHYSICAL REHABILITATION DEVICE AND METHOD

(75) Inventor: Koralee K. Jones, Mt. Shasta, CA (US)

(73) Assignee: The Gentle Walker, LLC, Mt. Shasta, CA (US)

( * ) Notice: Subject to any disclaimer, the term of this patent is extended or adjusted under 35 U.S.C. 154(b) by 1197 days.

(21) Appl. No.: 11/171,999

(22) Filed: Jun. 29, 2005

(65) Prior Publication Data

US 2006/0009332 A1 Jan. 12, 2006

Related U.S. Application Data

(60) Provisional application No. 60/586,286, filed on Jul. 9, 2004.

(51) Int. Cl.
*A63B 22/02* (2006.01)

(52) U.S. Cl. ..... 482/54; 482/51

(58) Field of Classification Search ..... 482/1–9, 482/51, 54; 119/700
See application file for complete search history.

(56) References Cited

U.S. PATENT DOCUMENTS

| | | | | |
|---|---|---|---|---|
| 3,642,279 | A | | 2/1972 | Cutter |
| 4,113,246 | A | | 9/1978 | Gibbs |
| 4,406,451 | A | | 9/1983 | Gaetano |
| 4,757,987 | A | | 7/1988 | Allemand |
| 4,892,090 | A | | 1/1990 | Kaeser |
| 4,998,725 | A | | 3/1991 | Watterson et al. |
| 5,290,205 | A | | 3/1994 | Densmore et al. |
| 5,441,468 | A | | 8/1995 | Deckers et al. |
| 5,470,293 | A | * | 11/1995 | Schonenberger ..... 482/54 |
| 5,476,430 | A | | 12/1995 | Lee et al. |
| 5,538,489 | A | | 7/1996 | Magid |
| 5,545,112 | A | | 8/1996 | Densmore et al. |
| 5,733,228 | A | | 3/1998 | Stevens |
| 5,772,560 | A | | 6/1998 | Watterson et al. |
| 5,833,577 | A | | 11/1998 | Hurt |
| 5,856,736 | A | | 1/1999 | Rotunda et al. |
| 5,868,648 | A | | 2/1999 | Coody et al. |
| 6,110,076 | A | | 8/2000 | Hurt |
| 6,241,638 | B1 | | 6/2001 | Hurt |
| 6,350,218 | B1 | | 2/2002 | Dalebout et al. |
| 6,419,612 | B1 | | 7/2002 | Yu |

(Continued)

FOREIGN PATENT DOCUMENTS

| | | |
|---|---|---|
| FR | 2 616 132 | 12/1988 |

(Continued)

OTHER PUBLICATIONS

Home Gyms & Exercise Equipment (2D-Corp.), "Phoenix MT 007 Motorized Treadmill," undated, 1 pg.

(Continued)

*Primary Examiner*—Glenn Richman
(74) *Attorney, Agent, or Firm*—Schwabe, Williamson & Wyatt, P.C.

(57) ABSTRACT

A physical rehabilitation device is disclosed including an endless belt for standing or walking thereon, which is pivotally attached to a maneuverable base. A motive force is supported by the maneuverable base and adapted to drive the endless belt at a slow constant speed, and being adjustable in small increments.

4 Claims, 8 Drawing Sheets

U.S. PATENT DOCUMENTS

| | | | | |
|---|---|---|---|---|
| 6,436,058 | B1 * | 8/2002 | Krahner et al. | 600/587 |
| 6,443,875 | B1 | 9/2002 | Golen, Jr. et al. | |
| 6,645,126 | B1 | 11/2003 | Martin et al. | |
| 6,733,422 | B2 | 5/2004 | Wu | |
| 6,743,153 | B2 | 6/2004 | Watterson | |
| 6,746,374 | B2 | 6/2004 | Chang | |
| 6,878,101 | B2 * | 4/2005 | Colley | 482/54 |
| 7,455,626 | B2 * | 11/2008 | Trevino et al. | 482/54 |
| 2004/0005961 | A1 | 1/2004 | Iund et al. | |

FOREIGN PATENT DOCUMENTS

| | | |
|---|---|---|
| WO | WO 88/00850 | 2/1988 |

OTHER PUBLICATIONS

Home Gyms & Exercise Equipment (2D-Corp.), "Phoenix Easy-Up 516 Manual Treadmill," undated, 1 pg.

Home Gyms & Exercise Equipment (2D-Corp.), "Phoenix Denise Austin Easy-up Manual Treadmill," undated, 1 pg.

Home Gyms & Exercise Equipment (2D-Corp.), "Phoenix Easy Up MT 832 Motorized Treadmill," undated, 2 pg.

Home Gyms & Exercise Equipment (2D-Corp.), "Phoenix Easy Up Power Treadmill," undated, 1 pg.

Cycle Sports & Fitness, "05 820p Treadmill," undated, 2 pg.

Quinton Rehabilitation Treadmills, "MedTrack CR/SR 60 Treadmills," Rev New Aug. 2002, 2 pg.

Trackmaster, "TMX425 Stress Treadmill," http://trackmastertreadmills, com/medical.asp, Feb. 10, 2005, 4 pg.

St. Maartenskliniek, "Treadmill Training in Patients with Incomplete Spinal Cord Injury," http://www.maartenskliniek.nl/sc/rehab/20626/20766, Feb. 10, 2005, 3 pg.

Boston Stirland Int'l, "Tunturi T3.5F Treadmill," 2005, 1 pg.

* cited by examiner

COMPACT PHYSICAL REHABILITATION DEVICE AND METHOD

RELATED APPLICATIONS

This application claims priority to U.S. Provisional Application No. 60/586,286, filed on Jul. 9, 2004 entitled "Portable Walking Machine," which is hereby fully incorporated by reference.

TECHNICAL FIELD

Embodiments of the present invention relate to, but are not limited to, rehabilitation devices, and in particular, to the field of portable durable rehabilitation machines with monitoring capabilities adapted to track measurable progressive increments.

BACKGROUND

Movement is an important component for a recovery, and/or a continued vitality regiment for patients recovering in hospitals, nursing home residents, and convalescents in private and group homes. However, due to various ailments and age-related issues, such people may often be confined to beds, for a significant portion of any recovery or convalescing period. While so bedridden, such persons are often connected to IV systems, catheters, and other medical and/or monitoring devices, which further hamper patient mobility.

To recover from most illnesses as quickly as possible, and it is beneficial for these patients to engage in some sort of walking, regardless of the pace. Additionally, such regular movement tends to prevent pooling and/or unnecessary accumulation of fluids in the body. Because of their physical condition, lack of confidence, and all of the attached medical devices, it is difficult to transport a patient to another location, such as a rehabilitation center, where they can engage in such a mild form of exercise in a controlled environment. The patient may also walk in a room or down the hall, for example, but again, due to the generally poor physical condition of the patient and the medical devices, such venturing may be dangerous and unmotivating. Any such form of exercise requires significant medical staff time and energy in lending assistance as well as monitoring the activities.

It also is difficult, if not impossible to bring exercise equipment to the patient, as the rooms are typically small, and filled with many obstacles. For example, many hospital rooms and nursing home rooms are at least double occupancy, and crowded with beds and multiple sets of equipment. The space between beds may be only a few feet wide. Additionally, state of the art treadmills are not a viable solution for a convalescing patient needing only to engage in minor walking, as such treadmills are geared for exercise and heart rate increase such that they typically have a minimum speed which is too fast. Further, such treadmills cannot start out gradually enough, and thus create a dangerous situation for the convalescing patient.

Treadmills without a motive force are likewise not a viable option, as they either provide too little resistance, giving the user a "slippery" feel, or they provide too much resistance requiring the user to exert a force to get them started. Often, the force exerted to get the belt to move is converted to momentum that makes the speed of the belt unpredictable.

Another reason a state of the art treadmill is inappropriate is that they display output that is either meaningless or inappropriate for a convalescing person. For example, a state of the art treadmill will output speed in miles per hour (mph) and distances in fractions of a mile. A convalescing patient and/or the medical practitioner responsible for their recovery must measure progress in smaller increments.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF ILLUSTRATIVE EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made in alternate embodiments. Therefore, the following detailed description is not to be taken in a limiting sense, and the scope of embodiments in accordance with the present invention is defined by the appended claims and their equivalents.

The following description may include terms such as inner, outer, under, between, upward, downward, outward, inward, top, bottom, above, below, and the like. Such terms are used for descriptive purposes only and are not to be construed as limiting in the description or in the appended claims. That is, these terms are terms that are relative only to a point of reference and are not meant to be interpreted as limitations but are, instead, included in the following description to facilitate understanding of the various aspects of the invention.

Embodiments of the invention may include elements having functions, features, dimensions, and proportions enabling the embodiments to be transported and maneuvered close to a patient's bed. Embodiments of the invention may be sufficiently available, simple, and unintimidating such that a weak and/or timid patient may be encouraged and otherwise helped to use the device.

Embodiments of the present invention may include an endless belt driven by a motive force, and which may be pivotally attached to a maneuverable base. Embodiments of the present invention may be directed to a rehabilitation device including a walking platform being driven at constant speed of less than 0.5 mph, and adapted to increase or decrease speed in increments of 0.05 mph. Embodiments of the present invention may also include one or more monitors to measure a patient's progress in sufficiently small increments, such that the patient's progress can be tracked as measurable progressive exercise.

Embodiments of the present invention may be configured such that the endless belt, when in an operational configuration is low to the ground in order to facilitate the patient's stepping thereon, as well as to mitigate the potential risk of a fall. Embodiments may include a frame supporting a belt, such frame having all parts thereof on one side of or sufficiently close to a pivot axis such that the frame may pivot upward from a very low pivot axis, and render the rehabilitation machine easily maneuverable and storable in a confined area.

The phrase "in one embodiment" is used repeatedly. The phrase generally does not refer to the same embodiment, however, it may. The terms "comprising", "having", and "including" are synonymous, unless the context dictates otherwise.

Figure 1:
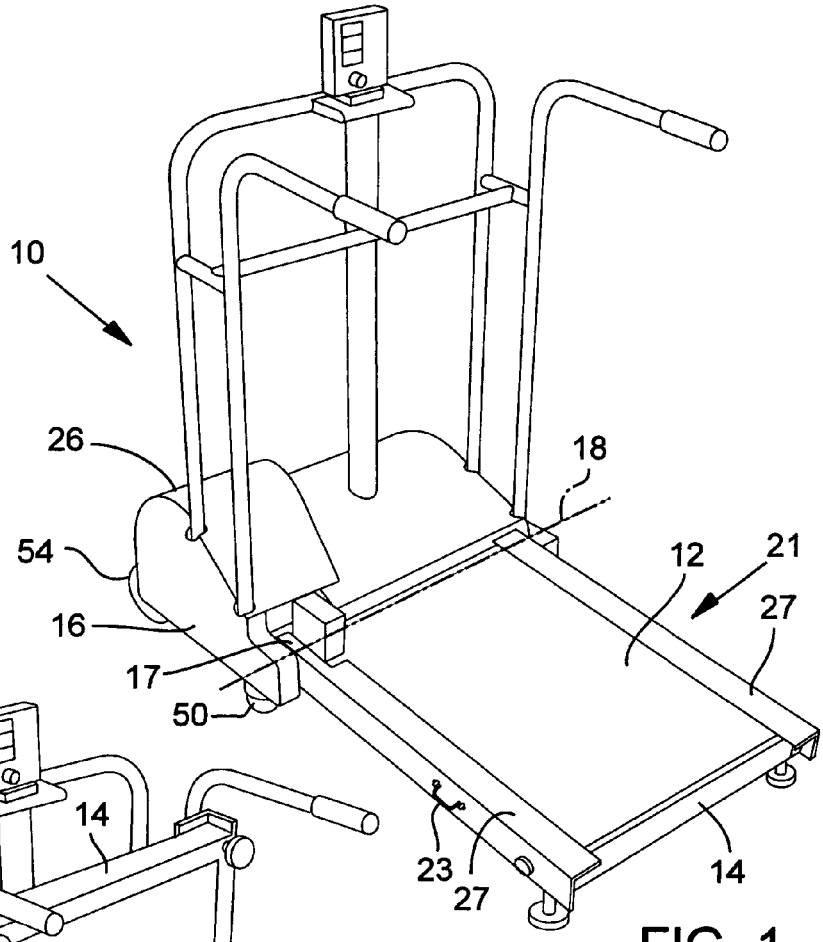
FIG. 1 illustrates a perspective view according to one embodiment of the invention.
Figure 2:
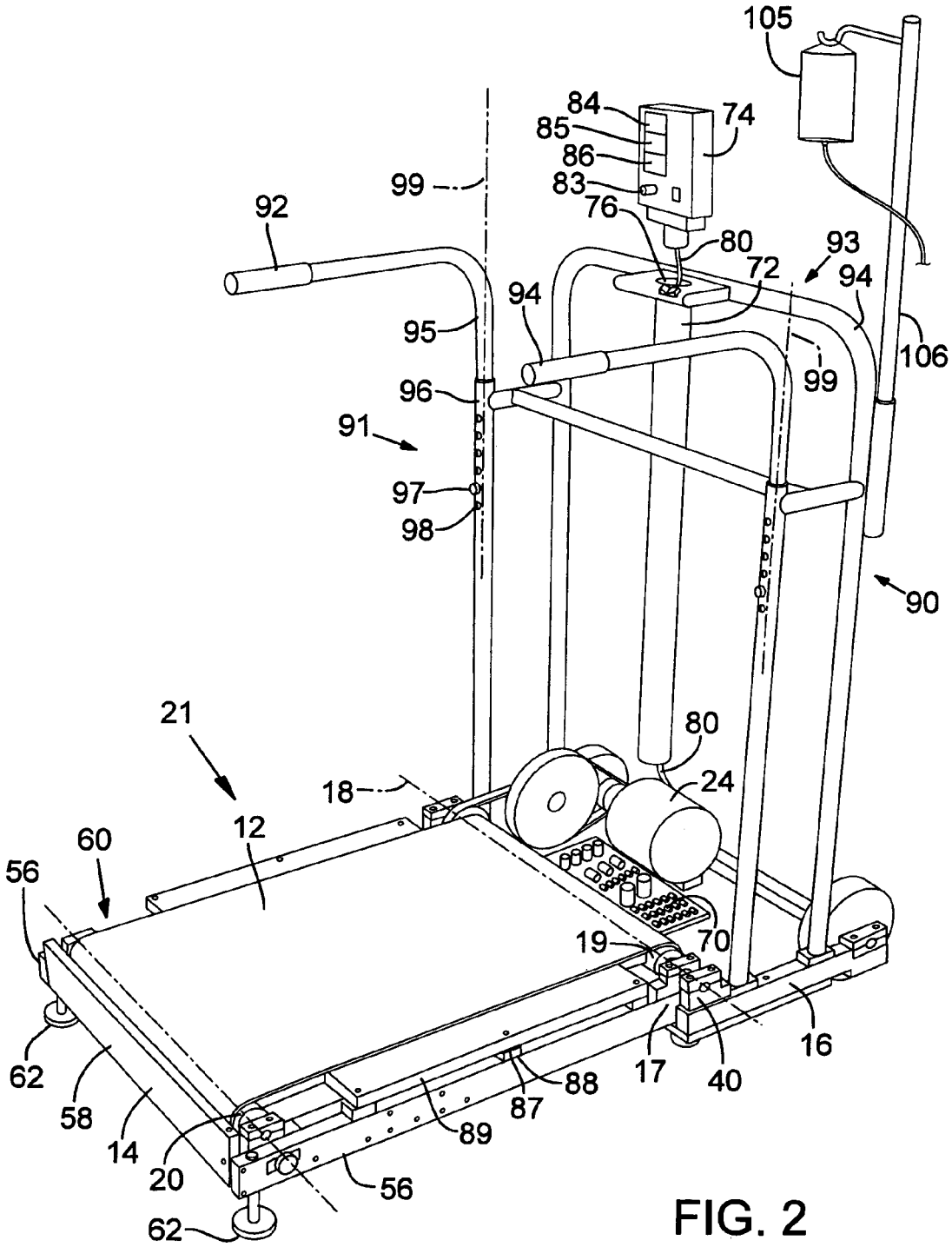
FIG. 2 illustrates a perspective view according to one embodiment of the invention shown in FIG. 1 with parts removed for illustration.

FIG. 1 illustrates a perspective view according to one embodiment of the invention. FIG. 2 illustrates a perspective of one embodiment with parts removed for illustration. A physical rehabilitation device 10 includes an endless belt 12 for walking or standing thereon. Endless belt 12 may be supported by a frame 14 and may be pivotally attached to a maneuverable base 16 at a first end 17. The endless belt 12 may be disposed for pivotal movement about a pivot axis 18. The frame may be designed to support a forward belt driver 19 and a rearward belt driver 20. Belt drivers 19/20 may be arranged to support the endless belt 12 for movement. In one embodiment of the present invention, the pivot axis 18 may be concentric with the forward belt driver 19, such that when the frame 14 is folded to a non-operational position (see FIG. 3), the endless belt 12 does not slacken.

Figure 3:
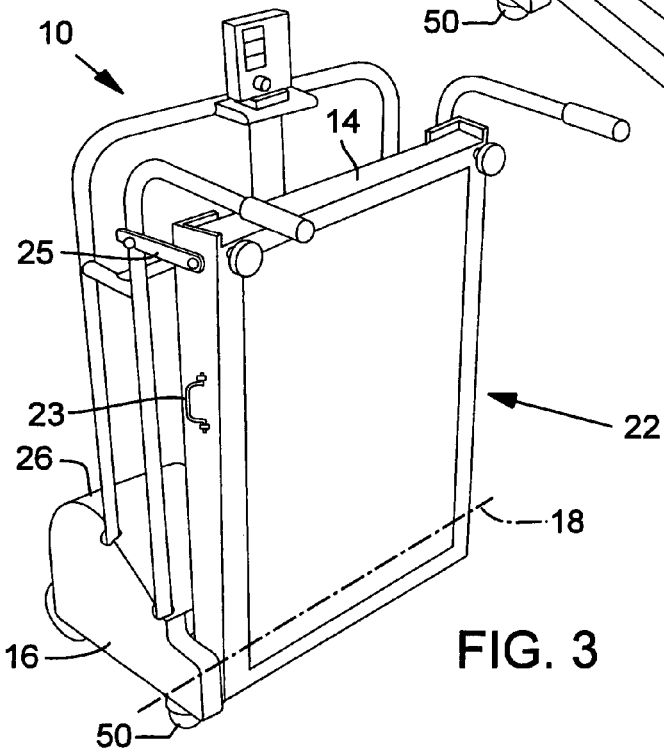
FIG. 3 illustrates a perspective view according to an embodiment of the invention shown in FIG. 1.

In FIGS. 1 and 2, the belt 12 is shown in a working or operational position 21 adapted for standing and walking thereon. FIG. 3 Illustrates a perspective view according to the embodiment of FIG. 1 showing the belt 12 in a non-operational or transport position 22, wherein the frame 14 and belt 12 have been pivoted about axis 18 such that they are in a substantially upright position. The frame 14 and belt 12 may be held in place with a latch 25. The frame 14 may also have one or more handles 23, adapted to facilitate movement of the frame 14 between the operational and non-operational configurations.

In one embodiment, a motive force, such as an electric motor 24 may be carried by the maneuverable base 16 and may be coupled to the forward belt driver 19 and adapted to controllably drive the endless belt 12 at various speeds. In one embodiment, for example, the motor 24 may drive the belt 12 at a constant speed in the range of 0 to 0.5 miles per hour (mph), and may vary the speed at 0.1 or 0.05 mph increments. Motor 24 and other components discussed later may be covered by a component housing 26, which in one embodiment, may be configured to minimize any sort of obstruction or engagement tendency with a patient's foot when walking on the belt 12. Side covers 27 may also be positioned about frame 14 and belt 12 for aesthetic and protective reasons.

Figure 5:
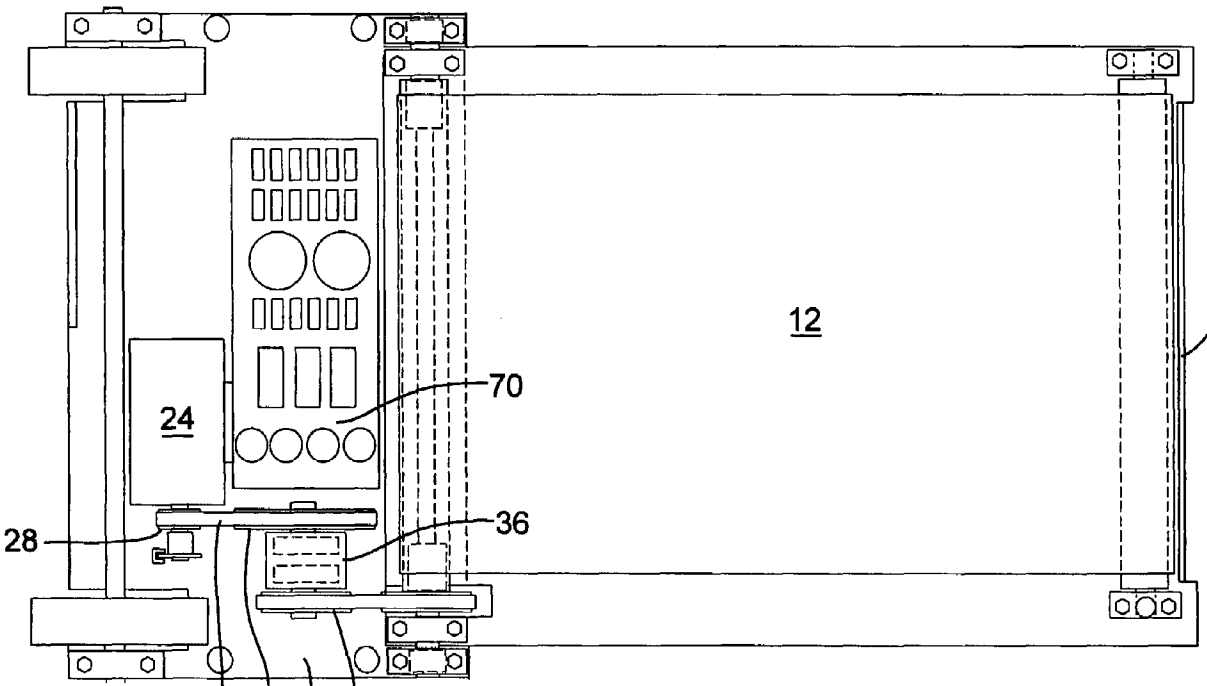
FIG. 5 illustrates a top view according to an embodiment of the invention shown in FIG. 1 with parts removed for illustration.
Figure 4:
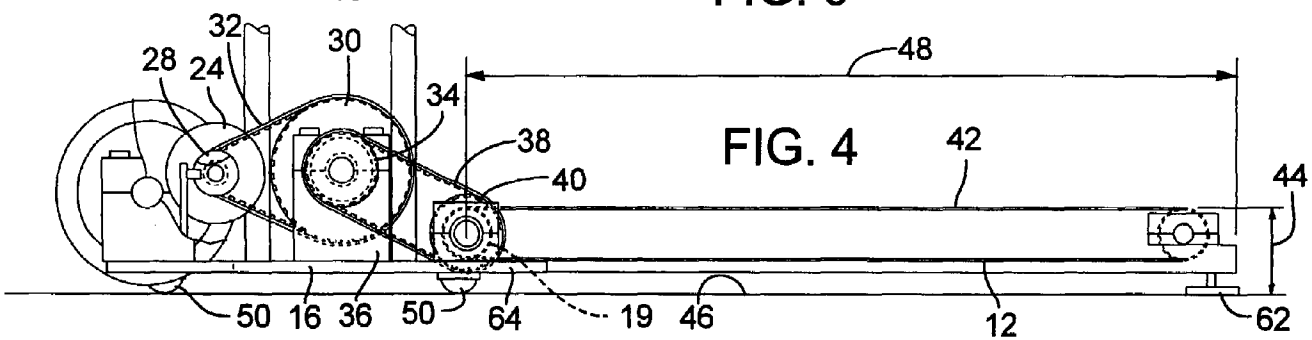
FIG. 4 illustrates a side view according to an embodiment of the invention shown in FIG. 1 with parts removed for illustration.

FIG. 4 illustrates a side view and FIG. 5 illustrates a top view of the embodiment shown in FIG. 1, each with parts removed and/or parts in section for illustration. In one embodiment of the present invention, the rehabilitation device 10 may include positive motion control of endless belt 12, wherein substantially no slippage or delay will occur in belt movement with regard to motor output. The motor 24 may be designed to directly drive belt 12 through one or more belts and pulleys adapted to resist slippage. For example, in one embodiment, a first toothed pulley 28 may be coupled to motor 24. Toothed pulley 28 may be drivably coupled to a second toothed pulley 30 via a first toothed belt 32. The second toothed pulley 30 may be coupled for mutual rotation to a third toothed pulley 34. Second and third toothed pulleys 30 and 34 may be supported by a bearing block 36. A second toothed belt 38 may drivably couple the third toothed pulley 30 to a fourth toothed pulley 40 which is coupled to the forward belt driver 19.

The sizes of the toothed pulleys 28, 30, 34, and 40 may be sized to translate, e.g., reduce, the rotational output speed of the motor to a desired rotational speed of the endless belt 12. In one embodiment, where the rotational output of the motor is relatively slow, the first toothed pulley 28 may be directly coupled to the fourth toothed pulley 40 with one belt. Again, the size of the toothed pulleys may be changed to increase or decrease the rotational speed translated from the motor 24 to the endless belt 12. In another embodiment the motor 24 may be coupled to the forward belt driver 19 via a gear train.

A top surface 42 of endless belt 12 may be adapted to be in a substantially horizontal position when in the operational configuration, and may also be a desired height 44 above a supporting surface 46, such as a floor. In one embodiment, the top surface 42 should be sufficiently low so as to make it easier for a person who has trouble walking to step onto it. The height 44 may be, for example, less than 6 inches, and in some embodiments, may be 3 inches or less. The top surface 42 may have a length 48 which may be adapted for a short to normal stride, i.e., not a jogging or running stride. In one embodiment, such a length 48 may be approximately 30 inches long. The frame may have all parts thereof on one side of the pivot axis or sufficiently close thereto such that the belt may be very low when in the horizontal position and pivot about a very low pivot axis. Likewise, the width of the frame 14 may be sufficiently narrow to facilitate portability and compactness. In one embodiment, the overall width of the frame 14 may be approximately 26 inches.

Figure 6A:
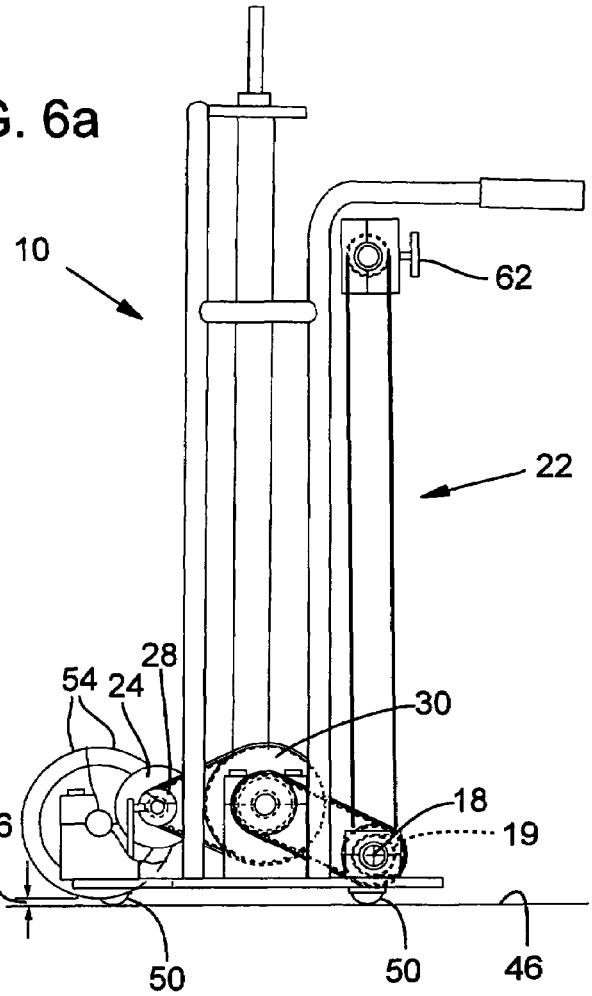
FIGS. 6*a* and 6*b* illustrate a side view according to an embodiment of the invention shown in FIG. 1.
Figure 6B:
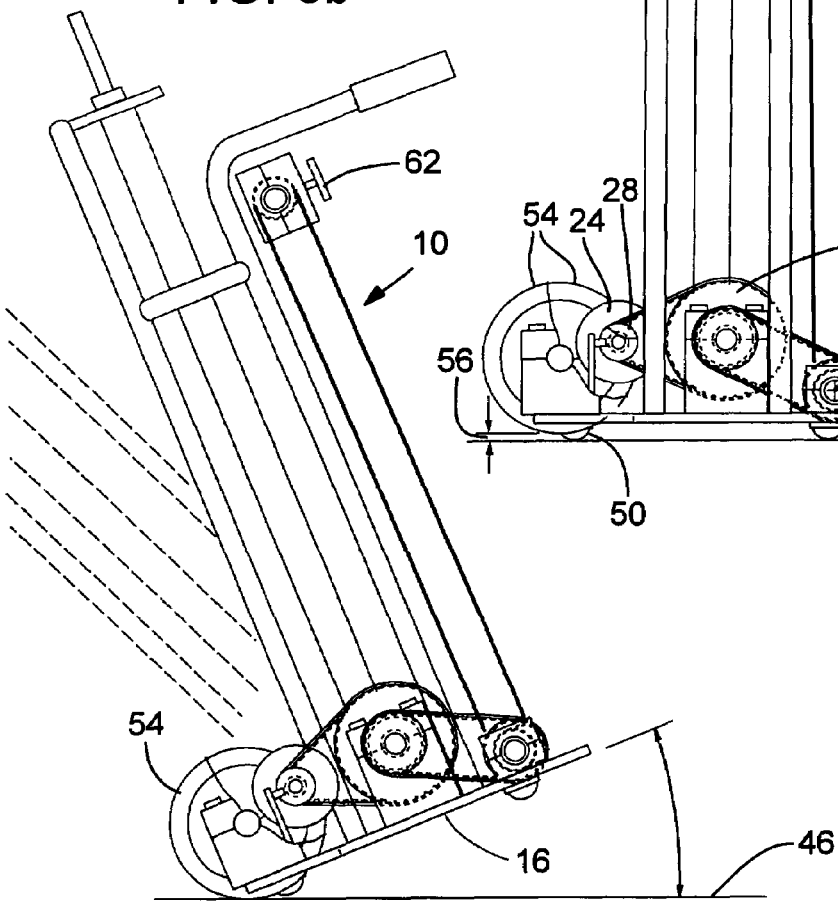

FIGS. 6*a* and 6*b* are side views of the embodiment shown in FIG. 1 with the component housing 26 and the side covers 27 removed for illustration. The physical rehabilitation device 10 is shown in the transport position 22 with the endless belt pivoted upward about axis 18. The maneuverable base 16 may be designed to be supported by three or more points of contact. For example, in the illustrated embodiment four castors 50 may support the maneuverable base 16, and may be adapted to allow the base 16 to be easily moved in any direction.

In one embodiment, the rehabilitation device 10 may also include wheels 54 coupled to the maneuverable base 16 and configured such that they are spaced a determined distance 56 from the underlying surface 46 when the maneuverable base 16 is supported by castors 50. The two wheels 54 are also adapted to contact the underlying surface 46 for rolling engagement when the maneuverable base 16 is tipped as shown in FIG. 6*b*. Such a configuration is helpful for transporting the physical rehabilitation device over long distances or rough or uneven terrain (e.g. stairs, elevator thresholds, etc.).

Referring again to FIG. 2, frame 14 may include two spaced apart side beams 56 and an end beam 58 connecting the side beams 56 at a second end 60 of the frame 14. At least one contact point which may be in the form of feet 62, may project from a bottom of the second end of the frame 14 and may be adjustable in height. Feet 62 may be adapted to support the frame 14 when in the operational configuration. The feet 62 may also be made of a slip resistant material, such that the feet 62 will help resist unwanted movement of the rehabilitation device 10 on casters 50 when in use.

Referring back to FIG. 4 a stop 64, which may be, in the form of an extension of the maneuverable base 16, may prevent rotation of the frame 14 and endless belt 12 past a substantially horizontal position. Thus, for example, if the rehabilitation device 10 is tilted slightly while in the operating position, the stop 64 will cause the frame 14 and endless belt 12 to rise in an upward direction upon further tilting of the device 10, which in turn will cause feet 62 to disengage the ground surface without folding the frame 14 into the non-operational configuration. The physical rehabilitation device 10 may then be maneuvered slightly, such as to slide the frame and endless belt closer to a bed.

In one embodiment of the present invention, the rehabilitation device may include a control board 70 which may include control circuitry, for example, a logic circuit on a printed circuit board, that may be adapted to control among other things power input and output, belt behavior, monitoring, and the like. The control circuitry may be supported by the maneuverable base 16 and may also be housed in the component housing 26. The control circuitry may also be a storage medium such as a hard drive, or be coupled to a storage medium wherein data to keep track of a patient's incremental progress may be at least saved, stored, copied, edited, or transferred.

The motor 24 may be selected to provide constant torque, or constant or diminishing torque, for example, one rated for ¾ hp, 1725 rpm, and 90 volts. For example, a motor made by Dayton model 2m169D or model 2m169.

Referring again to FIGS. 1 and 2, an access member 72 may extend from the component housing 26, and may be adapted to support a user interface device 74. Interface device 74 may be configured to removably engage a cradle portion 76 and may be in communication with the control board 70. The user interface device 74 may be configured to do one or more of the following: display a distance traveled in increments on the order of a single step using units such as feet, meters, and yards; controllably provide input to control the speed of the belt 12; monitor and display time in use; and accept and provide data to track the progress of a patient over a time of days, weeks, or months. Such functionality may be at least partially controlled by the control board 70.

In one embodiment, the user interface device 74 may include: a speed indicator 84, to indicate the speed of the belt 12; a distance indicator 85 to indicate a distance walked; and a time indicator 86 to indicate a duration of exercise session, or duration of activity. One embodiment may include a control device with a so-called dead man's switch wherein if the control is let go of or dropped the belt may stop.

The access member 72 may be hollow, and configured to house one or more control, or power, lines illustrated by a wire 80 configured to electrically couple the user interface device 74 to the control board 70 and/or motor 24. The user interface device 74 may also include one or more connection sites, such as data sockets, and may be adapted to couple to a peripheral device such as a computer, printer or network connection, such that monitoring and/or input control may be manipulated at the location of the rehabilitation device or from a remote location. The user interface device may incorporate a peripheral device. In one embodiment, the input data may include information about a patient including but not limited to weight, age, medical condition, medical history, pulse, rate blood pressure, and oxygen saturation levels. The data may be combined and/or integrated with other data such as speed of the belt 12 and/or distance traveled.

In one embodiment, the user input device may be wirelessly coupled to the control board 70 and/or motor 24. Such a wireless coupling may allow a third person to have the user interface device at a remote location, e.g., a nurse's station, and still be able to monitor the progress of the person on the rehabilitation device.

In one embodiment, the user interface device may be configured to record and/or output data including: distance walked; speed, including average speed and peak speed; and time spent on the device. Sufficiently small increments may be measured such that sufficient resolution of the differences between therapy sessions may be noted. The recorded data may be compared to similar data from other sessions such that the measurable progressive exercise can be tracked. Tracking and/or monitoring measurable progressive exercise may be beneficial as it is often required by various insurance companies and/or government health plans to approve the use and funding of the physical rehabilitation device and/or personnel involved with its use.

In one embodiment, data may include identifying data, including but not limited to: a patient's name; a health record #, which may uniquely identify the patient; the patient's location, i.e., floor and room; the patient's date of birth (D.O.B.); his or her admit date; admission diagnosis (ICD code); and pertinent medical history. In one embodiment, data may also include data more directly related to the patient's rehabilitation targets. Data, including but not limited to: maximum heart rate, for example, 220 minus the patient's age; the patient's previous level of function; short-term goals; and long-term goals. In one embodiment, a data field may be provided to include a summary or comments related to the patient's therapy. In one embodiment, data fields may be included to more particularly relate to measurable progressive exercise, including, but not limited to: date and time of a particular therapy session on the device; heart rate measured during the particular therapy session; oximetry, i.e., level of oxygen saturation in the patient's blood before and/or after the particular therapy session; time spent on the device during the particular therapy session measured in, for example, minutes and seconds; average speed, and/or peak speed measured in, for example, feet per minute, yards per minute, meters per minute, feet per second, yards per second, meters per second; distance walked in, for example, feet, yards, or meters. A collection of data may be referred to as a use record. The user interface may be adapted to record and compare past use records with a current session to track measurable progressive exercise.

In one embodiment, data may be manually recorded and tracked in, for example, a table, and/or inputted into specified fields in a data base using, for example, a keyboard.

The user interface device 74 may be sized to be held in the hand of the user of the physical rehabilitation device 10, for example, a patient, or held by another such as a doctor, nurse, or therapist. In one embodiment a control device may be separate from a display device, for example, a handheld control device and a stationary display device, or different combinations thereof.

In one embodiment of the present invention, a power button may be positioned on the user interface device 74, and adapted to control power to the physical rehabilitation device 10 and the other display and control features. The user interface device 74 may include a control switch 83 adapted to allow the user to increase and decrease the speed of the belt 12 in gradual minute increments. In one embodiment, the control switch 83 may be a rheostat dial such that the speed may be, adjusted by turning the dial. The dial may include a plurality of detent positions to control the rate and feel of the rotation of the dial 83, as well as to allow for speed increase or decrease increments per detent position. Each detent position, for example, may change the speed of the belt by an increment of 0.05 or 0.1 mph. In another embodiment, the control switch 83 may include one or more push-button interfaces that enable the user to increase or decrease the speed by corresponding pushing of the buttons.

In one embodiment, a stop button or kill switch may also be provided, and may be adapted to stop the rehabilitation device if there is a safety concern. In one embodiment, the kill switch may be positioned on one of the hand grips 92 or 94, such that a user may easily stop the machine while maintaining a grip on the hand grips. In another embodiment, a magnetic switch may be used, wherein one portion of the magnet is coupled to the user, such that if the user falls off the machine, for example, the magnetic contact will break and the device will stop. Numerous other kill switch arrangements may be used without departing from the scope of the invention.

In one embodiment, the rehabilitation device may include a sensor 87 disposed between a spacer 88 and a deck plate 89, and may be adapted to detect the presence or absence of a person on the treadmill. The power to the machine may be controlled by the sensing of the presence of an individual on the machine, and/or may be used to signal an alarm.

In one embodiment, a tubular handle arrangement 90 may be used, which may have a first side 91 having the two hand grips 92 and 94 arranged to be held or grasped by a user while walking or standing on the belt. Hand grips 92 and 94 may be used to steady a patient to support some or all of the weight of the patient. The handle arrangement 90 also may have a second side 93 with a handlebar 94 adapted to be held for moving the physical rehabilitation device 10 on wheels 54.

The hand grips 92 and 94 may be vertically adjustable and may be adjusted according to the height of the patient. Adjustment may be made possible, for example, by including first and second telescopically mating parts 95 and 96. The first part 95 may include a biased member 97 adapted to engage one of a plurality of apertures 98 in second member 96. Telescopic adjustment may be made by pushing the biased member 97, adjusting the height of the first part 95 relative to second part 96 and allowing the knob to lockably engage in another aperture 98. The handles may also, or instead, be rotably adjustable around vertical axes 99. The hand grips 92 and 94 may then be located over the belt 12 in different positions according to the needs, or preferences, of the patient. Again, a variety of height adjustment mechanisms may be used to adjust the height of the hand grips 92 and 94.

Figure 7:
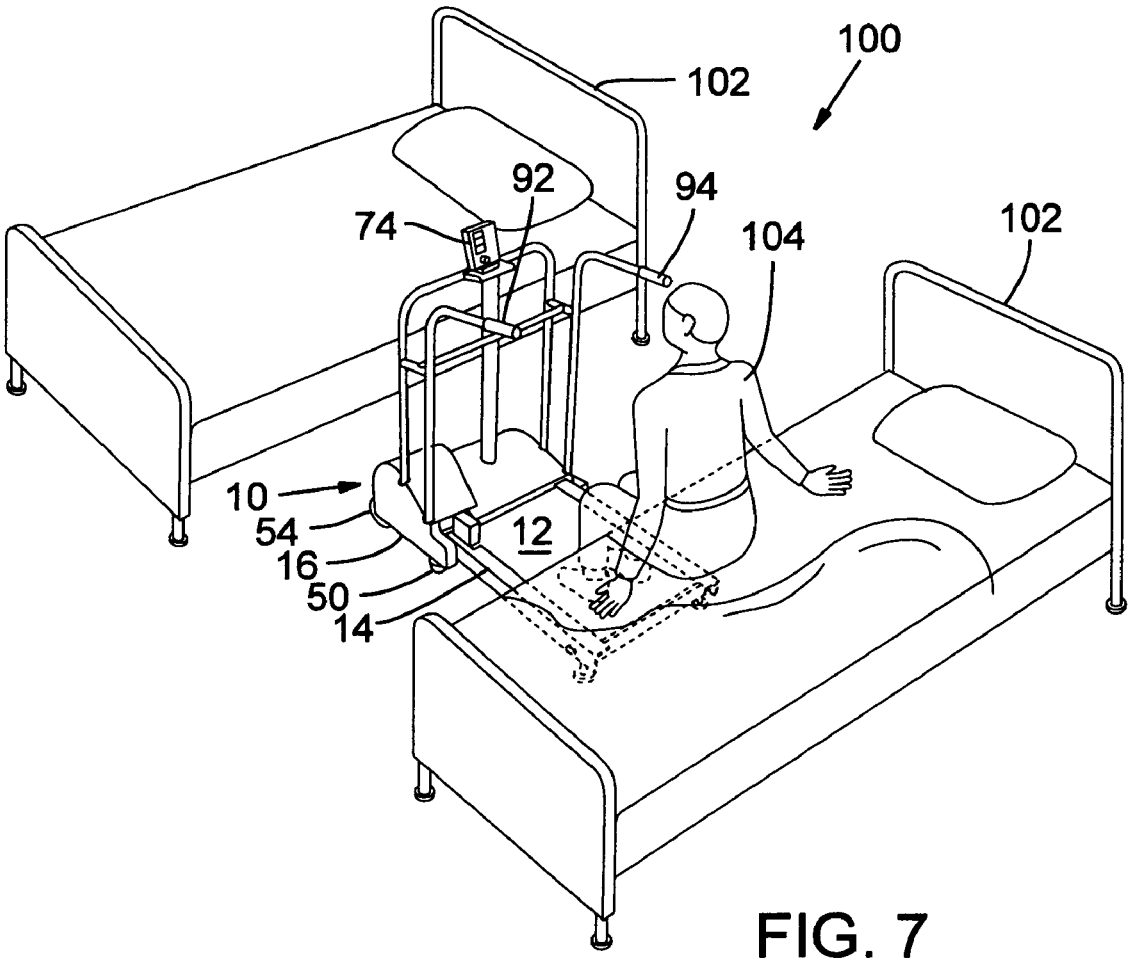
FIG. 7 illustrates a perspective view showing how embodiments of the invention may be used.

By way of example, FIG. 7 illustrates a perspective view of a hospital room 100 having two beds 102 therein. The physical rehabilitation device 10 may be maneuvered into and within the room by wheels 54, or on casters 50, while in the non-operational configuration. The device may be positioned between the two beds 102, and then may be rotated about a vertical axis and otherwise maneuvered on the maneuverable base 16 to face the belt 12 toward the patient's bed. The frame 14 and belt 12 may be lowered to the operational configuration (as shown). Final adjustments in position of the device may be made by tilting the device back slightly, as previously described, and moving the rear end of the belt as close to the bed threshold as desired.

Once in position, the patient 104 may then simply sit up in bed and with or without assistance swing their legs over the side of the bed to position their feet on or above the belt 12. The patient may grasp hand grips 92 and 94 and stand up on the belt 12. The belt 12 may then be started and set to move at a very slow speed, for example, 0.05 mph, or a faster speed, or started slowly and sped up, depending on the patient's strength and comfort level. The speed, distance traveled, and/or time spent walking may be recoded and compared to earlier or later session on the device 10, in order to measure progressive measurable exercise.

Embodiments of the present invention, the device 10 may be configured to support different medical devices that may be used to help or support a patient including, but not limited to, monitoring devices and IV bags, and the like. One IV bag 105 is illustrated in FIG. 2 supported by element 106 which may be removably attached, or made integral with the tubular handle arrangement 90.

Figure 8:
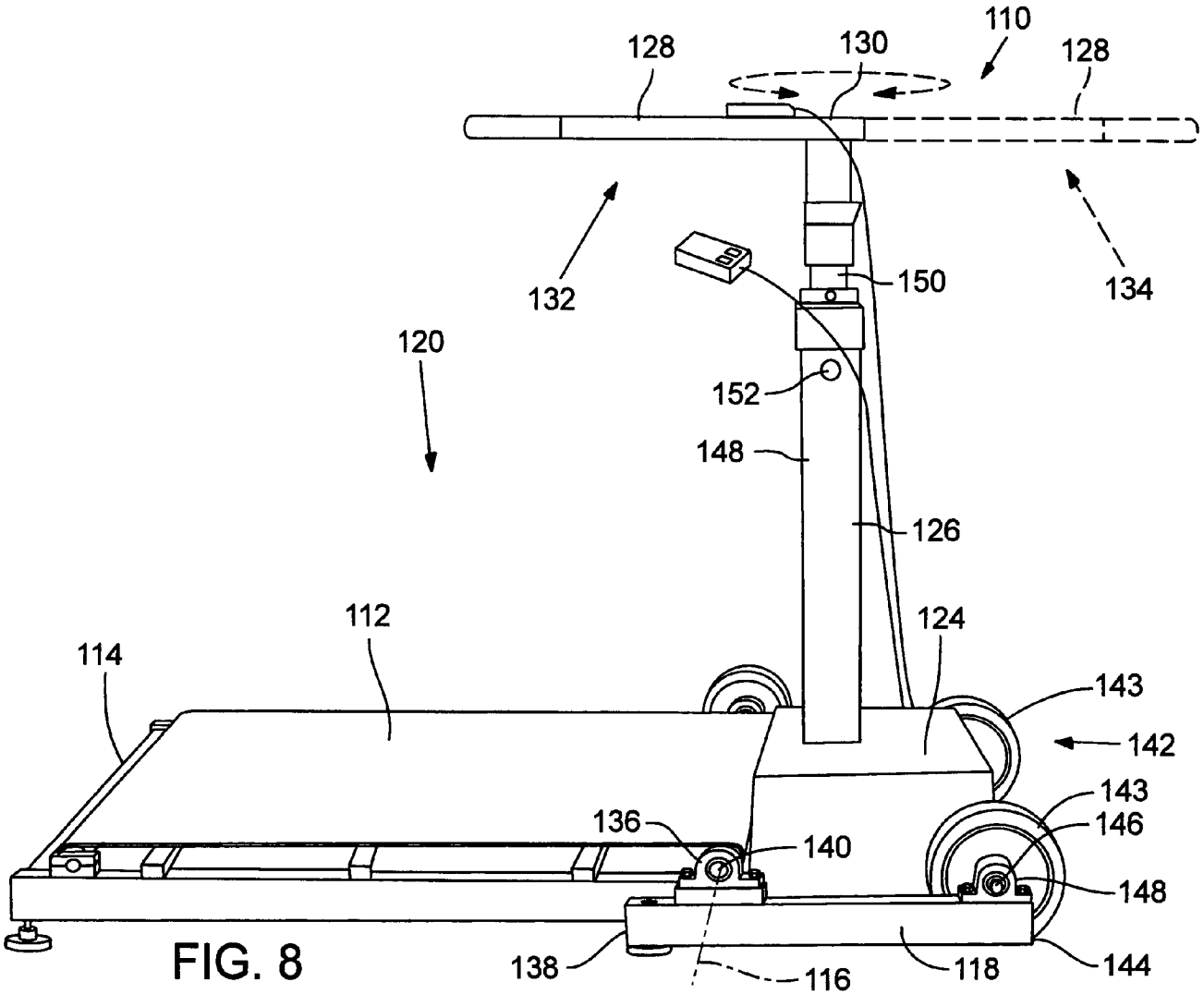
FIG. 8 illustrates a side view according to another embodiment of the invention shown in FIG. 1.
Figure 9:
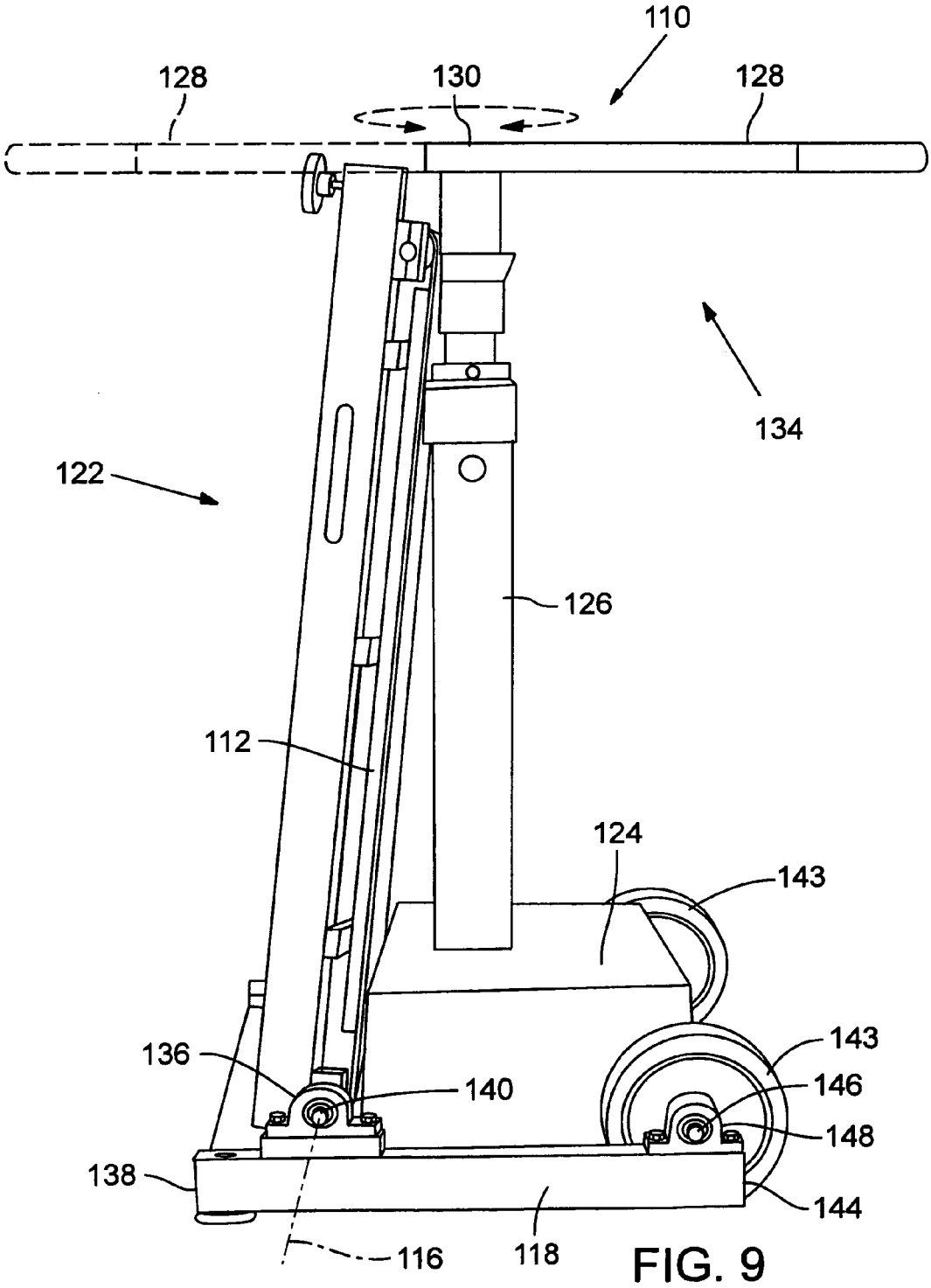
FIG. 9 illustrates a side view according to an embodiment of the invention shown in FIG. 8.

FIG. 8 Illustrates a front perspective view according to another embodiment of the invention. A physical rehabilitation device 110 includes an endless belt 112 supported by a frame 114 disposed for pivotal adjustment about an axis 116 on a maneuverable base 118. The belt 112 is shown in a working position 120, in FIG. 8, for standing and walking thereon. FIG. 9 Illustrates a front perspective view according to the embodiment of FIG. 8 showing the belt 112 in a transport position 122 wherein the belt 112 has been pivoted about axis 116 and is substantially upright.

The maneuverable base 118 may be configured to support a motor (not shown) which may be covered by a component housing 124, and may also be configured to support an upright member 126. A handle 128 may be connected to a top 130 of the upright member 126 connecting the handle 128 to the maneuverable base 118. The handle 128 has a first position 132, which may be used by a patient, for example, to hold or grasp when walking or standing on the belt 112. The handle may also have a second position 134, which may be used to transport the physical rehabilitation device 110.

A pair of pivot bearings 136 may be attached near a first side 138 of the maneuverable base 118 arranged to support a pivot axle 140 about which the frame 114 may pivot. A transport arrangement 142, in the form of two wheels 143 may be attached near a second side 144 of the maneuverable base 118. Wheels 143 may be mounted for rotation on a transport axle 146. In another embodiment of the invention the transport arrangement 142 can be separable from and connectable to the maneuverable base and used to transport the physical rehabilitation device 110.

The upright member 126 may include a first portion 148 fixed to the maneuverable base and a second portion 150 axially movable relative to the first portion. For example, the second portion 150 may be telescopically adjustable within the first portion 148. The handle 128 may be coupled to the second portion 150. The direction of the handle, i.e., whether the handle 128 is in the first position 132 or the second position 134, or any position therebetween, may be adjusted by rotating the second portion 150 relative to the first portion 148. A position lock 152 may be used to secure the first portion to the second portion in a desired axial position and desired height. Adjustment may be made by disengaging the position lock 152 and reengaging it when the desired position and height of the handle is achieved.

Referring to FIG. 9 The physical rehabilitation device 110 may be transported and readied for use by: grasping the handle 128 when the belt 112 is in the transport or non-operational configuration, and the handle 128 is in the second position 134, then tilting the physical rehabilitation device 110 to position most of weight of the physical rehabilitation device over wheels 143; moving the physical rehabilitation device to a patients' bedside pivoting the belt 112 to the working position 120 being substantially horizontal; then positioning the handle 128 in the first position 132 to be graspable by the patient. The rehabilitation device 110 may be further readied for use by adjusting the height of the handle 128 according the height and/or comfort of the patient.

The belt may be lockable and prevented from movement, for example, for safety and may also be prevented from movement while the motor provides movement to the first pulley to lift the frame 114 to put the physical rehabilitation device 110 in the transport position 122. The motor may be, for example, one rated for ¾ hp, 1725 rpm, and 90 volts. For example, a motor made by Dayton model 2m169D.

Figure 10:
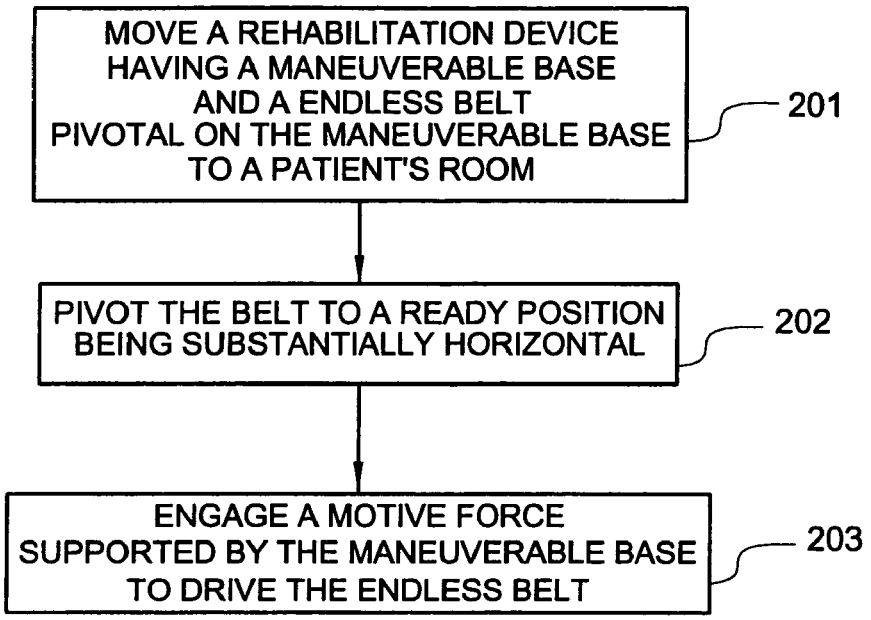
FIG. 10 is a flow diagram illustrating a method in accordance with an embodiment of the invention.

FIG. 10 is a flow diagram illustrating a method in accordance with an embodiment of the invention. The method includes:

moving a rehabilitation device having a maneuverable base and an endless belt for standing or walking thereon to a bedside, the belt being pivotal with respect to the maneuverable base, 201;

pivoting the belt to an operational position being substantially horizontal, 202; and engaging a motive force supported by the maneuverable base to drive the endless belt, 203, at a desired rate. The belt may be driven, for example, at a constant speed of less than 0.5 mph.

Figure 11:
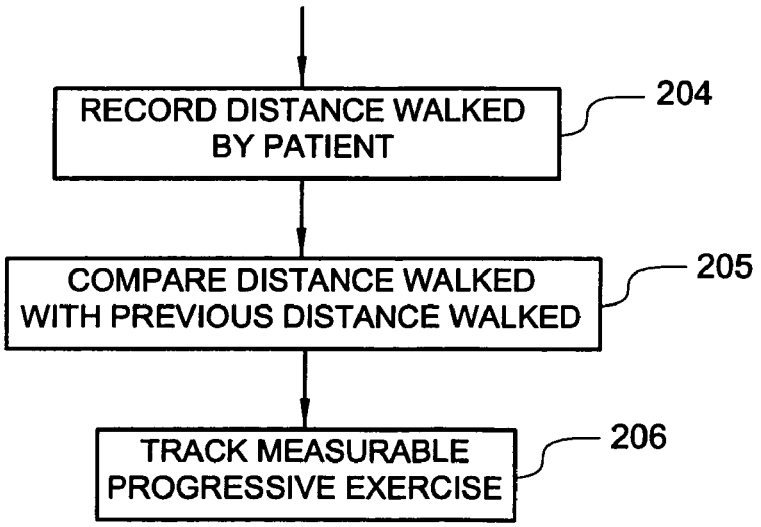
FIG. 11 is a flow diagram illustrating a method in accordance with an embodiment of the invention.

FIG. 11 is a flow diagram illustrating a method in accordance with another embodiment of the invention which may further comprise:

recording a distance walked by the patient, 204;

comparing the distance walked with a previous distance walked, 205; and tracking measurable progressive exercise, 206.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A physical rehabilitation device comprising:

an endless belt for standing or walking thereon being pivotally attached to a maneuverable base, the endless belt having an operational first position and a non-operational second position and a pivot axis is disposed between a first end area of the endless belt and the maneuverable base;

wherein in the operational first position, an upper surface of the endless belt is in a substantially horizontal and disposed between 2 and 6 inches above a floor to allow for the endless belt to be positioned adjacent or partially under a structure upon which a user is seated;

a motive force adapted to drive the endless belt at a user specified speed, wherein the user specified speed may be adjusted in increments of 0.05 miles per hour; and one or more handles disposed on the maneuverable base, the handles being adjustable relative to a user in both the vertical direction and the horizontal direction to allow rehabilitation users to grasp the handles in a variety of positions and to help with maneuvering the device.

2. The physical rehabilitation device of claim 1, further comprising:

At least three casters rotatably mounted to the maneuverable base and pivotable about separate vertical axes and to allow for maneuverability of the device along an underlying surface in an un-tipped position with multiple degrees of directional freedom; and At least two wheels coupled to the maneuverable base and spaced apart from the underlying surface when the endless belt is in the first or second position, the two wheels further configured to contact the underlying surface for rolling engagement when the maneuverable base is tipped.

3. The physical rehabilitation device of claim 1, further comprising:

a forward belt driver adapted to control movement of the endless belt, wherein the pivot axis is axially aligned with the forward belt driver; and wherein the motive force is supported by and stationary with respect to the maneuverable base as the endless belt rotates about the pivot axis to switch between the operational first position and the non-operational second position.

4. The physical rehabilitation device of claim 1, further comprising a user interface device adapted to control the speed of the endless belt, display information including one or more of belt speed, distanced traveled, and time in use, and to record and compare past use records with a current session to track measurable progressive exercise.

* * * * *